US008638948B2

(12) United States Patent
Schuijers et al.

(10) Patent No.: US 8,638,948 B2
(45) Date of Patent: Jan. 28, 2014

(54) MULTI-CHANNEL AUDIO SIGNAL PROCESSING

(75) Inventors: Erik Gosuinus Petrus Schuijers, Oss (NL); Sebastiaan de Bont, Eindhoven (NL)

(73) Assignee: NXP, B.V., Eindhoven (NL)

( * ) Notice: Subject to any disclaimer, the term of this patent is extended or adjusted under 35 U.S.C. 154(b) by 487 days.

(21) Appl. No.: 13/070,613

(22) Filed: Mar. 24, 2011

(65) Prior Publication Data

US 2011/0235809 A1 Sep. 29, 2011

(30) Foreign Application Priority Data

Mar. 25, 2010 (EP) ..... 10250574

(51) Int. Cl.
*H04R 5/00* (2006.01)

(52) U.S. Cl.
USPC ..... 381/17

(58) Field of Classification Search
USPC ..... 381/17
See application file for complete search history.

(56) References Cited

U.S. PATENT DOCUMENTS

| | | | | |
|---|---|---|---|---|
| 3,811,011 | A * | 5/1974 | Hardy et al. | 250/558 |
| 6,169,973 | B1 | 1/2001 | Tsutsui et al. | |
| 6,563,773 | B1 * | 5/2003 | Yanagisawa et al. | 369/44.41 |
| 7,085,331 | B2 * | 8/2006 | Seo | 375/308 |
| 7,715,567 | B2 | 5/2010 | Wildhagen | |
| 2003/0055636 | A1 * | 3/2003 | Katuo et al. | 704/225 |
| 2005/0207585 | A1 * | 9/2005 | Christoph | 381/71.11 |
| 2005/0254446 | A1 * | 11/2005 | Breebaart | 370/315 |
| 2006/0190247 | A1 * | 8/2006 | Lindblom | 704/230 |
| 2006/0206316 | A1 * | 9/2006 | Sung et al. | 704/207 |
| 2006/0233380 | A1 * | 10/2006 | Holzer et al. | 381/23 |

(Continued)

FOREIGN PATENT DOCUMENTS

| | | | |
|---|---|---|---|
| CN | 1197958 | A | 11/1998 |
| EP | 1 206 043 | A1 | 5/2002 |

(Continued)

OTHER PUBLICATIONS

Breebaart, J. et al., "Parametric Coding of Stereo Audio," J. Applied Signal Processing, vol. 9, pp. 1305-1322 (2004).*

Moorer, J. "The Use of the Phase Vocoder in Computer Music Applications," J. Audio Engineering Society, vol. 26, No. 1/2, pp. 42-45 (Jan. 1978).

Jot, J-M., "Digital Delay Networks for Designing Artificial Reverberators,", 90th Convention Audio Engineering Society, Preprint No. 3030 (E-2), 17 pgs. (Feb. 1991).

(Continued)

*Primary Examiner* — Duc Nguyen
*Assistant Examiner* — Sean H Nguyen

(57) ABSTRACT

The invention relates to multi-channel audio signal processing, in particular to a method of processing a multi-channel audio signal and to a signal processing device. A method of processing a multi-channel audio signal is disclosed, comprising the steps of: receiving an input sum signal (s) representing a sum of a first audio signal and a second audio signal; receiving an input difference signal (d) representing a difference between the first and second audio signals; decorrelating the sum signal to provide a decorrelated sum signal ($s_d$); calculating a first gain ($g_s$) from a cross-correlation of the sum and difference signals (s,d) and the power of the sum signal; calculating a second gain ($g_{sd}$) from a cross-correlation of the sum and difference signals (s,d) and the power of the sum and difference signals; calculating an output difference signal (d') from a sum of the first gain ($g_s$) applied to the sum signal (s) and the second gain ($g_{sd}$) applied to the decorrelated sum signal ($s_d$); and providing an output stereo audio signal (l,r) from a combination of the output difference signal (d') and the input sum signal (s).

12 Claims, 5 Drawing Sheets

(56) References Cited

U.S. PATENT DOCUMENTS

| | | | | |
|---|---|---|---|---|
| 2007/0194952 | A1* | 8/2007 | Breebaart et al. | 341/50 |
| 2007/0236858 | A1* | 10/2007 | Disch et al. | 361/272 |
| 2008/0048628 | A1* | 2/2008 | Lee | 323/271 |
| 2010/0014679 | A1* | 1/2010 | Kim et al. | 381/23 |
| 2010/0023335 | A1* | 1/2010 | Szczerba et al. | 704/500 |
| 2011/0106543 | A1* | 5/2011 | Jaillet et al. | 704/500 |
| 2013/0231940 | A1* | 9/2013 | Ehara | 704/500 |

FOREIGN PATENT DOCUMENTS

| | | | | | |
|---|---|---|---|---|---|
| JP | 2006148647 | A | * | 6/2006 | |
| WO | 03/090206 | A1 | | 10/2003 | |
| WO | WO 03090206 | A1 | * | 10/2003 | G10L 19/02 |
| WO | 2008/087577 | A1 | | 7/2008 | |
| WO | WO 2008087577 | A1 | * | 7/2008 | H04B 1/16 |

OTHER PUBLICATIONS

Herre J. et al., "Intensity Stereo Coding," 96th Convention Audio Engineering Society, Preprint No. 3799 (P3.9), 11 pgs. (Feb. 1994).

Harma, A., et al. "Frequency-Warped Signal Processing for Audio Applications," J. Audio Engineering Society, vol. 48, No. 11, pp. 1011-1031 (Nov. 2000).

Ekstrand, P. "Bandwidth Extension of Audio Signals by Spectral Band Replication," Proc. 1st IEEE Benelux Workshop on Model Based Processing and Coding of Audio, pp. 53-58 (Nov. 15, 2002).

Breebaart, J. et al., "Parametic Coding of Stereo Audio," J. Applied Signal Processing, vol. 9, pp. 1305-1322 (2004).

Extended European Search Report for Patent Appln. No. 10250574.0 (Jan. 18, 2011).

* cited by examiner

MULTI-CHANNEL AUDIO SIGNAL PROCESSING

CROSS-REFERENCE TO RELATED APPLICATIONS

This application claims the priority under 35 U.S.C. §119 of European patent application no. 10250574.0, filed on Mar. 25, 2010, the contents of which are incorporated by reference herein.

The invention relates to multi-channel audio signal processing, in particular to a method of processing a multi-channel audio signal and to a signal processing device.

FM radio was invented in the 1940's and extended for stereo broadcasts in the 1960's. The demodulated FM-stereo signal comprises a mono audio signal (L+R), a pilot tone of 19 kHz and a stereo difference signal (L−R) modulated on a 38 kHz sub carrier, as illustrated schematically in FIG. 1. The left and the right channels are reconstructed from the mono sum signal 101 and the difference signal 103. Although the received FM signal comprises white noise, the demodulated signal comprises a component that linearly increases with frequency (represented by noise signal 104). As the mono audio signal 101 is present in a lower frequency area (below 15 kHz) it contains a substantially lower noise level than the difference signal 103, which is transmitted at a higher frequency range in the FM signal. Known receivers therefore switch gradually from stereo to mono operation in case the signal to noise ratio of the input signal is too low.

In stereo broadcast FM signals, the left (L) and right (R) channels are matrixed into sum (S) and difference (D) signals, i.e. S=(L+R)/2 and D=(L−R)/2. A mono FM receiver will use just the S signal. A stereo receiver will matrix the S and D signals to recover L and R: L=S+D and R=S−D. As shown in FIG. 1, the sum signal 101 is transmitted as baseband audio in the range 30 Hz to 15 kHz (relative to the carrier frequency, corresponding to 0 Hz in FIG. 1). The difference signal 103 is amplitude-modulated onto a 38 kHz suppressed carrier to produce a double-sideband suppressed carrier (DSBSC) signal in the range 23 to 53 kHz. A 19 kHz pilot tone 102, at exactly half the 38 kHz subcarrier frequency and with a precisely defined phase relationship to it, is also generated. The pilot tone 102 is transmitted at 8-10% of overall modulation level and used by the receiver to regenerate the 38 kHz subcarrier with the correct phase.

The final multiplex signal from the stereo generator is the sum of the baseband audio signal 101, the pilot tone 102, and the DSBSC modulated subcarrier signal 103. This multiplex, along with any other subcarriers, is modulated by the FM transmitter.

In a typical FM receiver, an input signal is first subjected to a limiter in order to eliminate any amplitude modulation (AM) noise present in the signal. The output of the limiter is a square wave with a constant amplitude. The square wave is then sent through a bandpass filter with a centre frequency equal to the carrier frequency and a bandwidth equal to the bandwidth of the FM signal. The bandpass filter filters out the square wave harmonics and returns a constant-amplitude sinusoidal signal. The constant-amplitude FM signal is then differentiated. The instantaneous frequency is converted to an AM signal modulating the FM carrier function. An envelope detector extracts the amplitude, or envelope, of the input signal of interest. In this way the multiplex signal shown in FIG. 1 is retrieved. Subsequently a demultiplexer derives a sum signal s(t) and a difference signal d(t) from the multiplex signal.

As a consequence of differentiation, white noise present in the input signal becomes frequency dependent noise in the output signal. The RMS noise level is linearly proportional with the frequency. The power spectral density increases quadratically with frequency. This is described in more detail in "Information Transmission, modulation, and noise", by M. Schwartz, 3ed, chapter 5-12 (reference [9] below).

Accordingly, the difference signal 103, which is present around the suppressed carrier at 38 kHz is significantly more affected than the mono sum signal 101 in the range up to 15 kHz. Receivers therefore tend to automatically switch to mono audio reproduction if the level of noise in a stereo signal is too high, since most of this noise will derive from the difference signal 103.

An alternative method to that of switching off the difference signal has been proposed in US 2006/0280310 (reference [4] below), in which a frequency selective stereo to mono blending is used based on the masking effect of the human auditory system.

WO 2008/087577 (reference [1] below) discloses a system that also attempts to restore a reasonable stereo image while maintaining a low noise level, in which a stereo audio coding tool derived from a technique known as "Intensity Stereo" (IS) is used (disclosed in reference [3] below). According to this technique, instead of reinstating a noisy difference signal for creating a stereo signal an estimated difference signal is constructed. This estimated difference signal is created in the frequency domain by calculating a gain factor for each frequency band. A difference signal is then obtained by multiplying the frequency domain representation of the sum signal by the envelope of calculated gain parameters.

Although, the system disclosed in WO 2008/087577 can greatly improve the overall quality compared to either the stereo signal obtained by sum/difference reconstruction or the mono fallback option, it still poses a number of disadvantages. Firstly, the technique used does not fully exploit knowledge currently available in audio coding tools. Intensity Stereo is a stereo coding tool that has been largely superseded by more powerful tools such as Parametric Stereo (disclosed in reference [2] below). Secondly, the channel conditions, and therefore the noise conditions, of the sum and difference signal will tend to vary over time. This knowledge is not fully exploited in WO 2008/087577, which instead proposes heuristic measures to account for noisy channel conditions. Thirdly, the system does not describe how to behave in case channel conditions are either very poor or very good.

It is an object of the invention to address one or more of the above mentioned problems.

According to a first aspect of the invention there is provided a method of processing a multi-channel audio signal, the method comprising the steps of:

- receiving an input sum signal representing a sum of a first audio signal and a second audio signal;
- receiving an input difference signal representing a difference between the first and second audio signals;
- decorrelating the sum signal to provide a decorrelated sum signal;
- calculating a first gain from a cross-correlation of the sum and difference signals and the power of the sum signal;
- calculating a second gain from a cross-correlation of the sum and difference signals and the power of the sum and difference signals;
- calculating an output difference signal from a sum of the first gain applied to the sum signal and the second gain applied to the decorrelated sum signal; and
- providing an output stereo audio signal from a combination of the output difference signal and the input sum signal.

The first gain is optionally a complex-valued scaling factor, and may be calculated from a ratio of a complex-valued cross correlation between the sum and difference signals and the power of the sum signal.

The second gain may be calculated as a square root of a ratio of the residual signal power and the power of the sum signal.

The first and second gains may be set to a minimum when an estimate of signal to noise in the difference signal is below a set minimum threshold value.

The first and second gains may be set to a maximum when an estimate of signal to noise in the difference signal is above a set maximum threshold value.

The first and second gains may be set to a value between a minimum value and a maximum value depending on a value of an estimate of signal to noise in the difference signals being between a set minimum threshold value and a set maximum threshold value respectively.

The estimate of signal to noise in the difference signal may be a ratio calculated from a combination of real and imaginary parts of a filtered and demodulated version of the difference signal.

The multi-channel audio signal may be a frequency modulated signal comprising a baseband sum signal and a sideband modulated difference signal.

According to a second aspect of the invention there is provided a signal processing device for processing a multi-channel audio signal comprising an input sum signal representing a sum of a first audio signal and a second audio signal and an input difference signal representing a differences between the first and second audio signals, the device comprising:

- a decorrelation module configured to receive the sum signal and provide a decorrelated sum signal;
- a parameter estimation module configured to calculate a first gain from a cross-correlation of the sum and difference signals and the power of the difference signal and a second gain from a cross-correlation of the sum and difference signals and the power of the sum and difference signals;
- a first amplifier configured to receive the sum signal and amplify the sum signal according to the first gain;
- a second amplifier configured to receive the decorrelated sum signal and amplify the decorrelated sum signal according to the second gain;
- a summing module configured to sum output signals from the first and second amplifiers; and
- an output stage configured to calculate an output stereo signal from a combination of the sum signal and an output signal from the summing module.

The first gain is optionally a complex-valued scaling factor, and the parameter estimation module may be configured to calculate the first gain from a ratio of a complex-valued cross correlation between the sum and difference signals and the power of the sum signal.

The parameter estimation module may be configured to calculate the second gain as a square root of a ratio of the residual signal power and the power of the sum signal.

The parameter estimation module may be configured to set the first and second gains to a minimum when an estimate of signal to noise in the difference signal is below a set minimum threshold value.

The parameter estimation module may be configure to set the first and second gains to a maximum when an estimate of signal to noise in the difference signal is above a set maximum threshold value.

The parameter estimation module may be configured to set the first and second gains to a value between a minimum value and a maximum value depending on a value of an estimate of signal to noise in the difference signals being between a set minimum threshold value and a set maximum threshold value respectively.

The signal processing device may comprise a noise estimation module configured to provide the estimate of signal to noise in the difference signal from a ratio calculated from a combination of real and imaginary parts of a filtered and demodulated version of the difference signal.

The invention may be embodied as a computer program for instructing a computer to perform the method according to the first aspect. The computer program may be stored on a computer-readable medium such as a disc or memory. The computer may be a programmable microprocessor, application specific integrated circuit or a general purpose computer such as a personal computer.

Embodiments according to the invention comprise a number of improvements that can deliver a significant reduction in noise and improvement in output sound quality, in particular with respect to the system disclosed in WO 2008/087577. These improvements include:

i) the use of decorrelation in a similar way to current parametric stereo coding methods;

ii) the use of upmixing techniques that depend on the signal (or signal plus noise) to noise ratio of the difference signal, which is preferably applied in a time and frequency variant manner to allow upmixing to be applied to each Time/Frequency (T/F) tile depending on the local SNR of the T/F tile; and iii) the use of a hybrid scheme where, for each T/F tile, a gradual transition from an original difference signal to an estimated difference signal to using no difference signal (i.e. a sum signal alone).

Details of exemplary embodiments according to aspects of the invention are described below with reference to the accompanying drawings, in which.

Figure 3A:
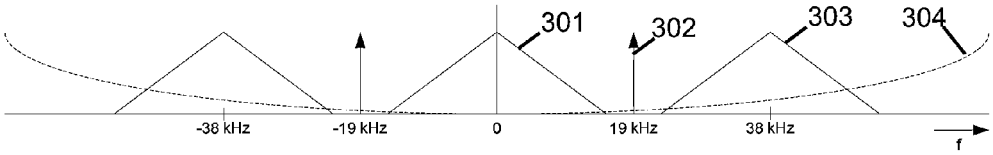
Figure 3B:
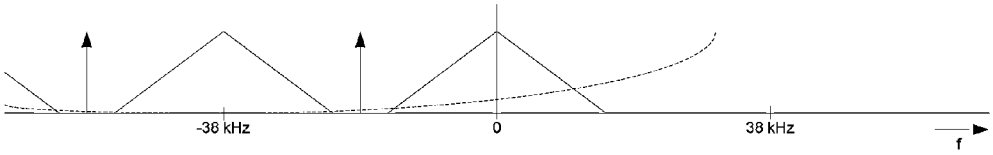

FIG. 3*a* is a schematic representation of power spectral density of a frequency modulated multiplex signal in the frequency domain;

FIG. 3*b* is a schematic representation of power spectral density of a complex filtered version of the signal of FIG. 3*a;*

Figure 3C:
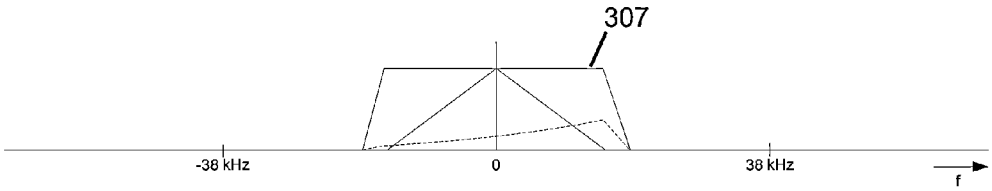
Figure 3D:
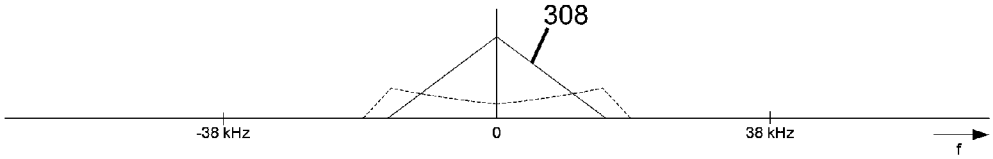

FIG. 3*c* is a schematic representation of power spectral density of the signal of FIG. 3*b* after modulation to the baseband;

FIG. 3*d* is a schematic representation of power spectral density of the real part of the signal in FIG. 3*c;*

Figure 3E:
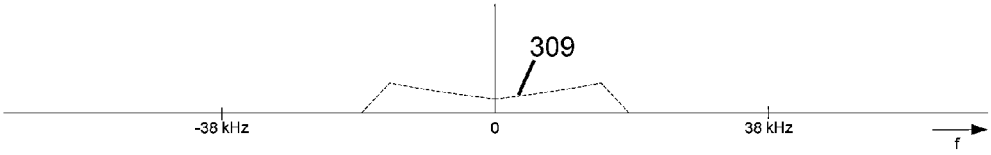

FIG. 3*e* is a schematic representation of power spectral density of the imaginary part of the signal in FIG. 3*c;*

Figure 4:
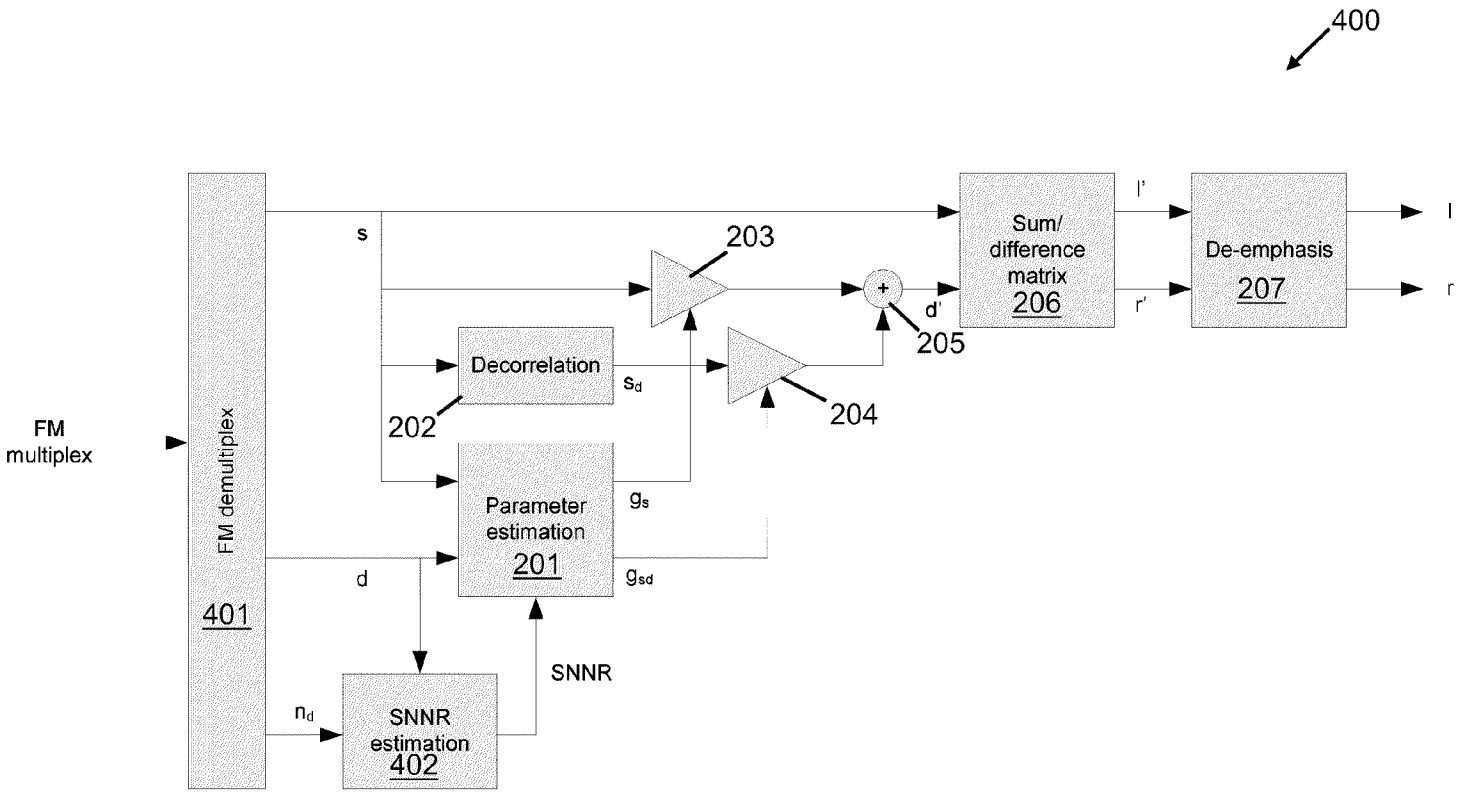
Figure 5:
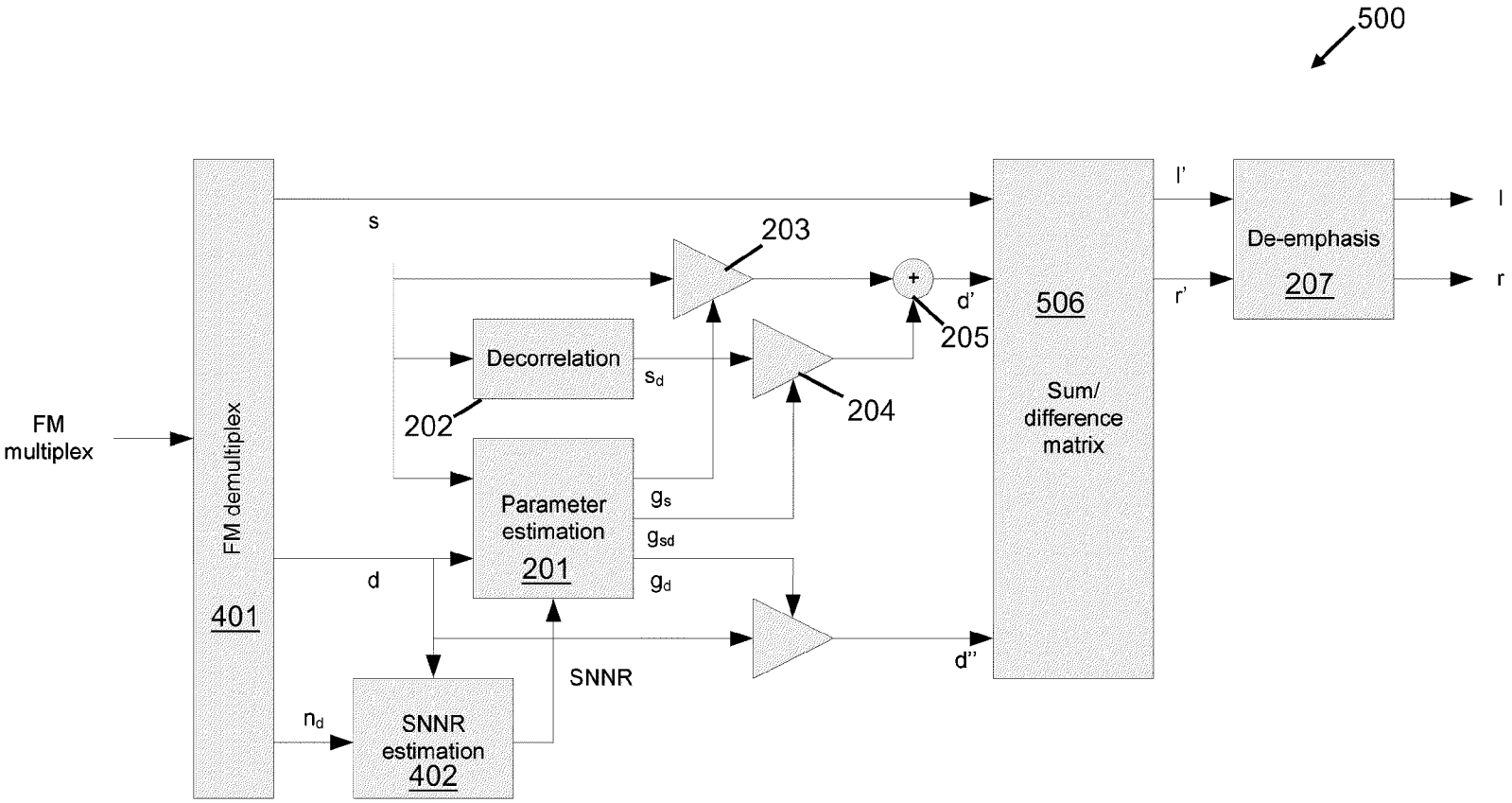

FIG. 4 is a schematic block diagram of a second exemplary embodiment of a signal processing device according to the invention;

FIG. 5 is a schematic block diagram of a third exemplary embodiment of a signal processing device according to the invention.

FIRST EMBODIMENT

Figure 2:
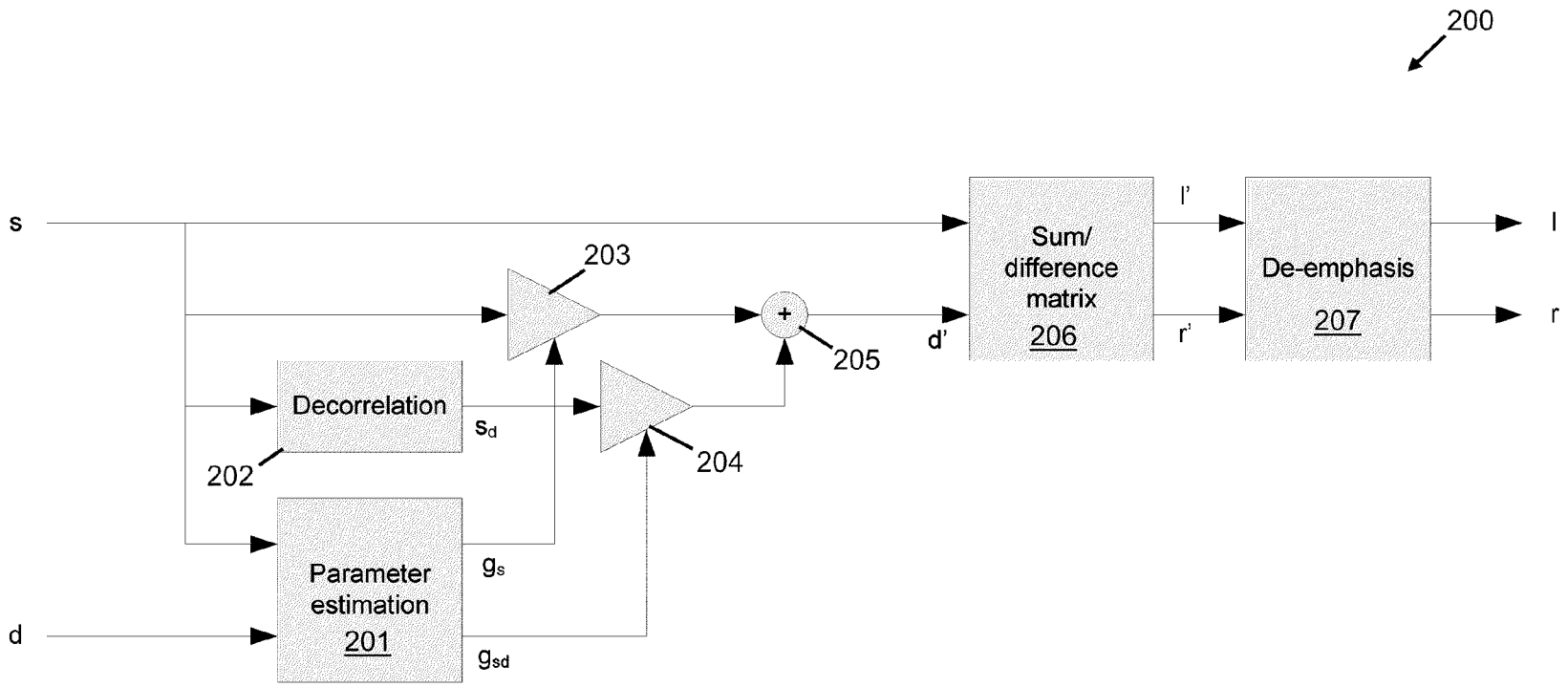
FIG. 2 is a schematic block diagram of a first exemplary embodiment of a signal processing device according to the invention.

FIG. 2 shows a block diagram of a first embodiment of a signal processing device 200 according to the invention, in which an improved difference signal d is calculated in noisy signal conditions. Noisy sum and difference signals s and d are input to a parameter estimation module 201. Based on the signal power of the sum and the difference signals and a cross-correlation of the sum and the difference signal, two gains, $g_s$ and $g_{sd}$, are calculated. These gains are used to define the following transfer function from the sum signal s and a decorrelated version of the sum signal $s_d$ to an estimated prediction signal d':

$$d'=g_s \cdot s+g_{sd} \cdot s_d$$

In comparison with the way the difference signal is calculated in WO 2008/087577, the above relationship includes an additional decorrelated signal component term $g_{sd} \cdot s_d$.

The gains $g_s$, $g_{sd}$ can be calculated as a function of the power of the sum and difference signals s, d and a non-normalized cross-correlation between the sum and difference signal, according to the following relationships:

$$g_s = \frac{\sum_{\forall p} s^* \cdot d + \varepsilon}{\sum_{\forall p} s \cdot s^* + \varepsilon}$$

$$g_{sd} = \sqrt{\frac{\sum_{\forall p} (d - g_s \cdot s) \cdot (d - g_s \cdot s)^* + \varepsilon}{\sum_{\forall p} s \cdot s^* + \varepsilon}}$$

where $$\sum_{\forall p} x \cdot y^*$$

represents the complex-valued inner product of the signal vectors x,y. The parameter $\epsilon$ is a small positive value to prevent division by zero. Therefore, effectively the parameter $g_s$ is calculated as the ratio of the complex-valued (complex-conjugate) cross correlation between the sum/difference signal pair and the power of the sum signal. This provides the least-squares fit. The parameter $g_{sd}$ is calculated as square root of the ratio of the residual signal power and the power of the sum signal.

In parallel with the parameter estimation process, the sum signal s is also input to a decorrelation module 202, in which a decorrelated sum signal $s_d$ is derived that has a correlation with the sum signal s substantially close to zero and having approximately the same temporal and spectral shape as the sum signal s. The decorrelation module 202 can be implemented for example by means of all-pass filters or by reverberation circuitry. An example of a synthetic reverb is given in Jot, J. M. & Chaigne, A. (1991), Digital Delay Networks for designing Artificial Reverb, 90th Convention of the Audio Engineering Society (AES), Preprint Nr. 3030, Paris, France (reference [5] below).

After decorrelation and parameter estimation, gains $g_s$, $g_{sd}$ are applied to the sum signal s and the decorrelated sum signal $s_d$ by means of first and second amplifiers 203, 204. The output signals $g_s \cdot s$, $g_{sd} \cdot s_d$ from the amplifiers 203, 204 are provided to a summing module 205 and added together, resulting in a synthetic difference signal d'. The sum signal s and the synthetic difference signal d' are then fed through a conventional sum and difference matrix module 206, which derives left and right audio signals l', r' according to the following relationship:

$$\begin{bmatrix} l' \\ r' \end{bmatrix} = \begin{bmatrix} 1/2 & 1/2 \\ 1/2 & -1/2 \end{bmatrix} \begin{bmatrix} s \\ d' \end{bmatrix}$$

The left and right signals l', r' are output by the sum/difference matrix module 206 to a de-emphasis filter module 207, which derives an output stereo signal. The de-emphasis module 207 operates to invert a pre-emphasis that is applied during the frequency modulation process. In alternative embodiments, the de-emphasis module may be applied to the input sum and difference signals s, d instead.

The processing described above is preferably conducted in a number of frequency bands in order to provide the highest fidelity. In each case, the input multiplexed time domain signals will need to be first converted to the frequency domain, and converted back to the time domain after processing. Frequency and time domain conversions may be carried out by discrete Fourier transformation (DFT, a fast implementation using FFT) as for example described in Moorer, The Use of the Phase Vocoder in Computer Music Applications Journal of the Audio Engineering Society, Volume 26, Number 1/2, January/February 1978, pp 42-45 (reference [6] below), or applied to sub-band representations for example by using Quadrature Mirror Filter (QMF) banks, as for example described in P. Ekstrand, Bandwidth Extension of Audio Signals by Spectral Band Replication, Proc. 1st IEEE Benelux Workshop on Model based Processing and Coding of Audio (MPGA-2002), Leuven, Belgium, Nov. 15, 2002 (reference [7] below], or warped Linear Predictive (LP) structures as for example described in A. Härmä, M. Karjalainen, L. Savioja, V. Välimäki, U. K. Laine, and J. Huopaniemi. Frequency-warped signal processing for audio applications. J. Audio Eng. Soc., 48:1011-1031, 2000 (reference [8] below).

SECOND EMBODIMENT

According to a second embodiment, the signal processing device of the first embodiment may be extended by the use of noise information that can be derived from the difference signal d. A trade-off can be made between the signal attributes corresponding to a stereo image and to noisiness of the signal, which may to some extend be separable.

Figure 1:
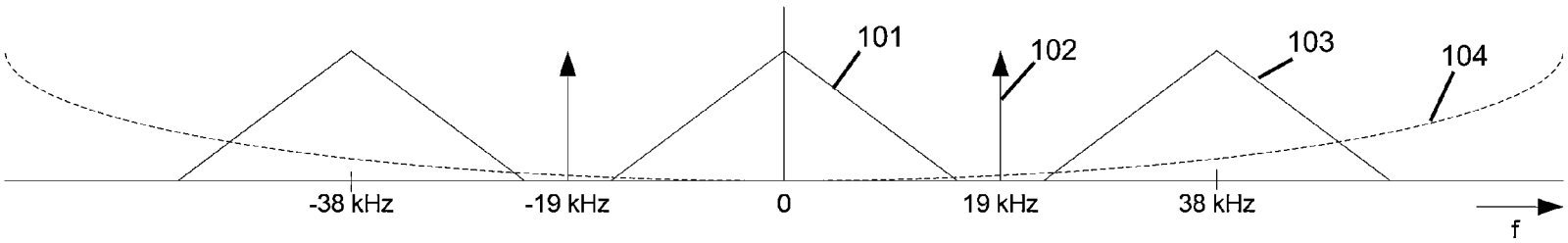
FIG. 1 is a schematic diagram of power spectral density of a frequency modulated multiplex signal in the frequency domain.

FIG. 3*a*, which is a reproduction of FIG. 1, illustrates a schematic representation of the Power Spectral Density (PSD) of an input FM multiplex signal. The input signal comprises a baseband sum signal 301 (between 0 and 15 kHz), a 19 kHz pilot tone 302 and a double sideband suppressed carrier modulated difference signal 303 (between 23 and 53 kHz). A noise signal 304 is also present, which tends to increase with increasing frequency.

The difference signal 303 is effectively available twice, once in the frequency range from 23 to 38 kHz and once in the frequency range from 38 to 53 kHz. Hence, using this knowledge both the difference signal d, which consists of d=d+n, i.e., the original difference signal plus an additional noise component, is available as well as $n_d$, where $n_d$ is an approximation of the noise signal n. The signals d and $n_d$ can be obtained as illustrated in FIGS. 3*b* to 3*e*. Quadrature modulation (modulation with complex-exponential) is first applied to the original input spectrum of FIG. 3*a* with a modulation frequency of 38 kHz. This results in a complex-valued signal having the spectrum indicated in FIG. 3*b*. This signal is then lowpass filtered to approximately 15 kHz, resulting in the signal shown in FIG. 3*c* (the bandpass filter indicated by the bandpass function 307). The resulting complex valued signal comprises the demodulated signal d as well as the complex-modulated signal n. By taking the real part 308 and imaginary part 309 of this signal, the components d and $n_d$ can be obtained, as illustrated in FIGS. 3*d* and 3*e*.

As a consequence, a ratio of the signal plus noise to the noise (SNNR) of the difference signal can be estimated.

The power of the difference signal d consists of the power of the difference signal plus the power of the noise estimate, under the assumption that there is zero correlation between the difference signal and the positive and negative noise components. In practice, accidental correlations may exist leading to deviations between the actual noise level of the difference signal and the noise estimate.

From the difference signal and the difference noise estimate, the SNNR can be estimated according to the following relationship:

$$SNNR = 10 \cdot \log_{10}\left(\frac{\sum_{\forall p} d \cdot d^*}{\sum_{\forall p} n_d \cdot n_d^*}\right)$$

The SNNR can be used as a means to control the parameter estimation. FIG. 4 is a block diagram representation of a signal processing device 400 according to the second embodiment, in which this SNNR is used to control the parameter estimation module 201. As with the device 200 of the first embodiment, the sum and difference signals s, d are provided from an FM demultiplexer 401. In addition, the difference signal d and a difference noise signal estimation $n_d$ are provided to an SNNR estimation module 402. The SNNR is then derived from the difference signal d and the difference noise signal $n_d$. The SNNR is then input to the parameter estimation module 201 to adapt the estimated parameters $g_s$, $g_{sd}$ output by the parameter estimation module 201.

Use of the SNNR as control information is applicable in situations where the difference signal is overwhelmed by noise, i.e. where the SNNR is approximately 0 dB. In such cases, the estimated parameters $g_s$, $g_{sd}$ are not employed, since they would in such cases be solely based on the noise signal. For example, the SNNR can be used to weight the gains $g_s$ and $g_{sd}$ such that, for an SNNR below a certain threshold, for example below 1 dB, the gains are set to 0, thereby yielding a mono signal. Between a specified range of SNNR values, for example between 1 dB and 5 dB, the estimated gains are scaled with a weight between 0 and 1. For SNNR values above a specified threshold, for example 5 dB, the gains are left unaltered. These relationships can be expressed as the following relationships:

$$g_s = g_{s,measured} \cdot f_1(\text{SNNR})$$

$$g_{sd} = g_{sd,measured} \cdot f_2(\text{SNNR})'$$

where $f_1$ and $f_2$ are functions having a range of between 0 and 1.

As with the first embodiment, the above processing is preferably conducted in a time and frequency variant manner. The noise estimates may vary substantially from the actual noise levels for very small time and frequency tiles since the noise estimate signal $n_d$, only provides an estimate of the actual noise signal n. Furthermore, due to poor reception conditions, such as e.g. multi-path reception effects, the noise estimate signal $n_d$ may substantially deviate from the actual noise signal. Therefore, the SNNR may be further processed to remove high frequent variations.

THIRD EMBODIMENT

According to a third embodiment, the device of the second embodiment can be adapted to also allow for scaling up to transparency for low noise levels. A signal processing device 500 according to the third embodiment is illustrated in FIG. 5. In addition to the scheme of the second embodiment, in which an SNNR estimation is derived, in the third embodiment the original difference signal d may be employed in a further way. If the SNNR is above a certain threshold, for example 15 dB, it can be beneficial to use the original difference signal instead of the synthetic difference signal d', the derivation of which is described above for the first and second embodiments. A hybrid scheme may be implemented, in which, for each T/F tile, a more optimal quality can be derived depending on the actual SNNR.

In this embodiment, as well as in the second embodiment, the use of a metric to control the behaviour of the parameter estimation module 201 is required. This metric does not necessarily need to be an SNNR estimate as detailed above, but could be a different metric that can be used to provide an estimate of signal to noise in the difference signal. An alternative metric may, for example, be a measure of a level of the received input signal. The use of SNNR is therefore a specific embodiment of a more general control metric that represents an estimate of signal to noise in the difference signal.

The mix matrix used by the sum/difference matrix module 506 for calculating the output signals l', r' then becomes the following:

$$\begin{bmatrix} l' \\ r' \end{bmatrix} = \begin{bmatrix} 1/2 & 1/2 \\ 1/2 & -1/2 \\ 1/2 & -1/2 \end{bmatrix} \begin{bmatrix} s \\ d' \\ d'' \end{bmatrix}$$

The effect of this is that the gain $g_d$ and the combined gains of $g_s$ and $g_{sd}$ will operate in a complementary fashion.

Other embodiments are within the scope of the invention, as defined by the appended claims.

REFERENCES

[1] WO 2008/087577 A1

[2] J. Breebaart, S. van de Par, A. Kohlrausch and E. Schuijers, "Parametric Coding of Stereo Audio", in *EURASIP J. Appl. Signal Process.*, vol 9, pp. 1305-1322 (2004).

[3] J. Herre, K. Brandenburg, D. Lederer, "Intensity Stereo. Coding," 96th AES Convention, Amsterdam, 1994, Preprint. 3799.

[4] US 2006/0280310 A1.

[5] Jot, J. M. & Chaigne, A. (1991), Digital Delay Networks for designing Artificial Reverb, 90th Convention of the Audio Engineering Society (AES), Preprint Nr. 3030, Paris, France.

[6] Moorer, The Use of the Phase Vocoder in Computer Music Applications Journal of the Audio Engineering Society, Volume 26, Number 1/2, January/February 1978, pp 42-45.

[7] P. Ekstrand, Bandwidth Extension of Audio Signals by Spectral Band Replication, Proc. 1st IEEE Benelux Workshop on Model based Processing and Coding of Audio (MPGA-2002), Leuven, Belgium, Nov. 15, 2002.

[8] A. Härmä, M. Karjalainen, L. Savioja, V. Välimäki, U. K. Laine, and J. Huopaniemi. Frequency-warped signal processing for audio applications. J. Audio Eng. Soc., 48:1011-1031, 2000.

[9] M. Schwartz, "Information Transmission, modulation, and noise", 3ed, chapter 5-12

The invention claimed is:

1. A method of processing a multi-channel audio signal, the method comprising the steps of:

receiving an input sum signal representing a sum of a first audio signal and a second audio signal;

receiving an input difference signal representing a difference between the first and second audio signals;

decorrelating the sum signal to provide a decorrelated sum signal;

calculating a first gain from a cross-correlation of the sum and difference signals and a power of the sum signal;

calculating a second gain from a cross-correlation of the sum and difference signals and a power of the sum and difference signals;

calculating an output difference signal from a sum of the first gain applied to the sum signal and the second gain applied to the decorrelated sum signal; and providing an output stereo audio signal from a combination of the output difference signal and the input sum signal.

2. The method of claim 1 wherein the first gain is a complex-valued scaling factor.

3. The method of claim 1 wherein the first gain is calculated from a ratio of a complex-valued cross correlation between the sum and difference signals and the power of the sum signal.

4. The method of claim 1 wherein the second gain is calculated as a square root of a ratio of a residual signal power and the power of the sum signal.

5. The method of claim 1 wherein the first and second gains are set to a minimum when an estimate of signal to noise in the difference signal is below a set minimum threshold value.

6. The method of claim 1 wherein the first and second gains are set to a maximum when an estimate of signal to noise in the difference signal is above a set maximum threshold value.

7. The method of claim 1 wherein the first and second gains are set to a value between a minimum value and a maximum value depending on a value of an estimate of signal to noise in the difference signal being between a set minimum threshold value and a set maximum threshold value respectively.

8. The method of claim 1 wherein the difference signal is provided as the output difference signal when a value of an estimate of signal to noise in the difference signal is above a set maximum threshold value.

9. The method of claim 5 where the estimate of signal to noise in the difference signal is a ratio calculated from a combination of real and imaginary parts of a filtered and demodulated version of the difference signal.

10. The method of claim 1 wherein the multi-channel audio signal is a frequency modulated signal comprising a baseband sum signal and a sideband modulated difference signal.

11. A signal processing device for processing a multi-channel audio signal comprising an input sum signal representing a sum of a first audio signal and a second audio signal and an input difference signal representing a difference between the first and second audio signals, the device comprising:

a decorrelation module configured to receive the sum signal and provide a decorrelated sum signal;

a parameter estimation module configured to calculate a first gain from a cross-correlation of the sum and difference signals and a power of the difference signal and a second gain from a cross-correlation of the sum and difference signals and a power of the sum and difference signals;

a first amplifier configured to receive the sum signal and amplify the sum signal according to the first gain;

a second amplifier configured to receive the decorrelated sum signal and amplify the decorrelated sum signal according to the second gain;

a summing module configured to sum output signals from the first and second amplifiers to provide an output difference signal; and an output stage configured to calculate an output stereo signal from a combination of the sum signal and the output difference signal from the summing module.

12. A non-transitory computer-readable medium encoded with a computer program for instructing a computer to perform the method according to claim 1.

* * * * *